United States Patent [19]

Bryant

[11] 3,934,282

[45] Jan. 27, 1976

[54] SAFETY TRIP LOCK FOR THE DROP SIDE OF A CRIB

[75] Inventor: Robert G. Bryant, Gardner, Mass.

[73] Assignee: GEM Industries, Inc., Gardner, Mass.

[22] Filed: Sept. 10, 1974

[21] Appl. No.: 504,809

[52] U.S. Cl. ..... 5/100; 5/331

[51] Int. Cl.[2] ..... H47C 2100

[58] Field of Search ..... 5/100, 331

[56] References Cited

UNITED STATES PATENTS

| | | | |
|---|---|---|---|
| 3,365,731 | 1/1968 | Royce | 5/100 |
| 3,590,403 | 7/1971 | Mixon | 5/100 |
| 3,846,854 | 11/1974 | Bryant | 5/100 |

*Primary Examiner*—Paul R. Gilliam
*Assistant Examiner*—Andrew M. Calvert
*Attorney, Agent, or Firm*—Charles R. Fay

[57] ABSTRACT

Safety trip lock for the drop side of a crib comprising a trip wire having an intermediate offset actuator portion, said wire extending to the ends of the crib and terminating in offset portions similar to cranks, together with a torsion spring maintaining said trip wire in a predetermined position, and latches at the end of the crib, i.e., on the corner posts, for receiving said offset ends in recesses therein, such that the trip cannot be operated unless the entire drop side is raised prior to moving the trip wire actuator.

1 Claim, 3 Drawing Figures

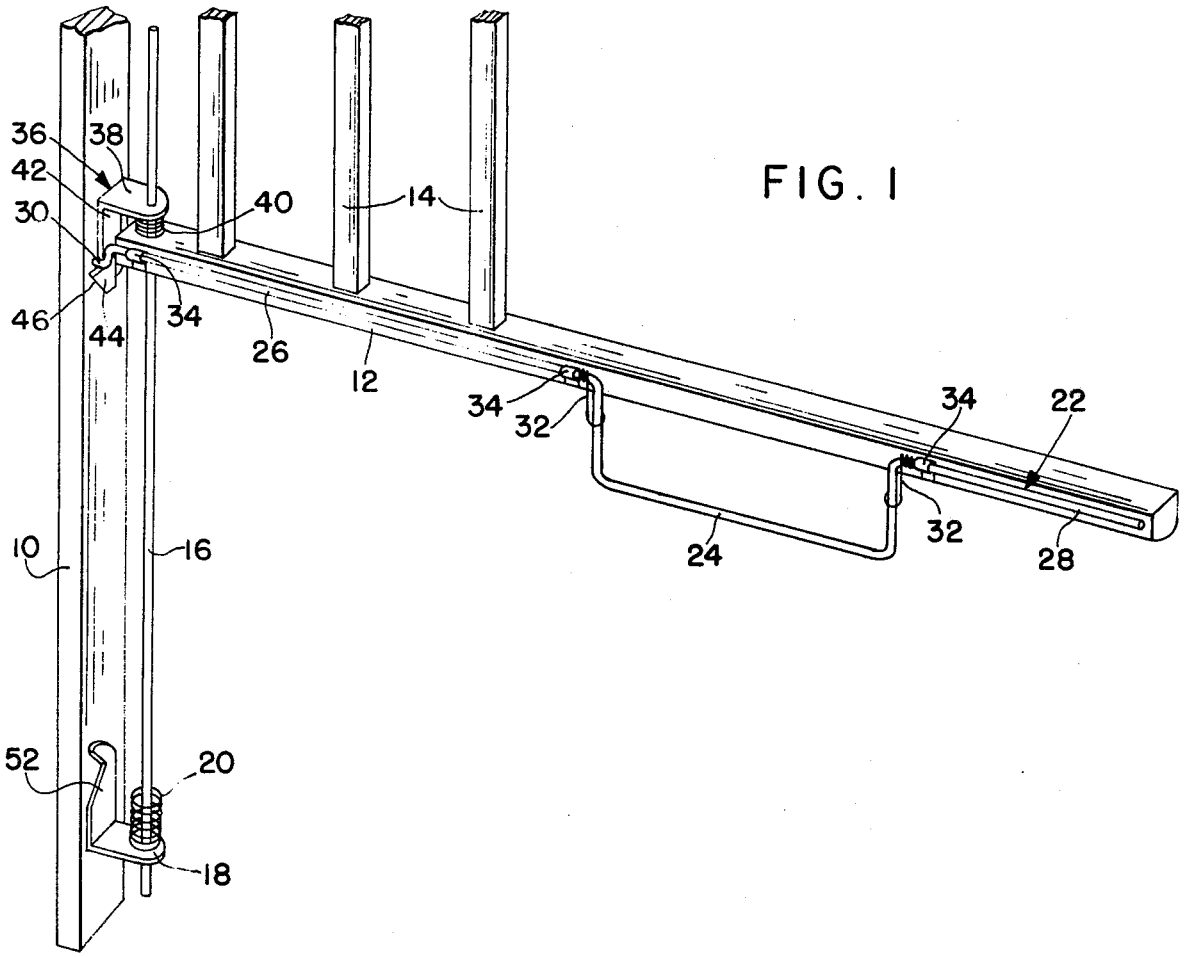
FIG. 1
FIG. 2
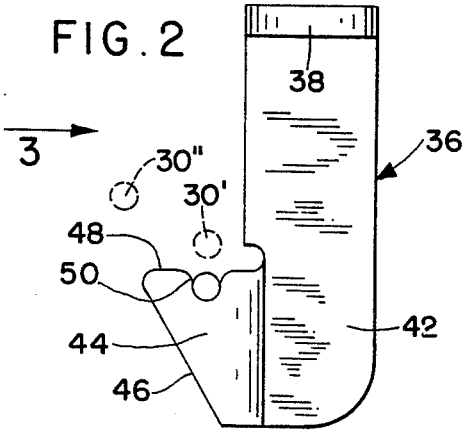
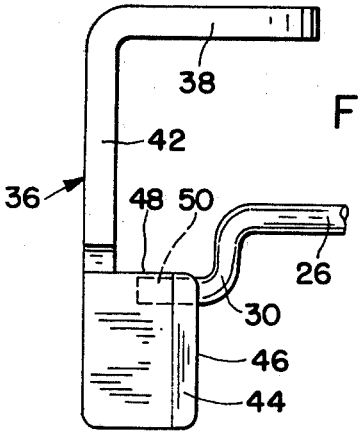
FIG. 3

SAFETY TRIP LOCK FOR THE DROP SIDE OF A CRIB

BACKGROUND OF THE INVENTION

It is an important consideration to provide for safety devices relative to the drop sides of cribs. In the prior art, devices of this nature ordinarily have depending trips which can be easily operated accidentally to unlatch the drop side as by another child or an animal to allow the drop side to drop thus removing the safety of the presence of the drop side and also allowing the drop side to drop and injure another child.

SUMMARY OF THE INVENTION

In the present case the drop side is provided with an elongated trip wire having an intermediate offset actuator and extending from the ends of the actuator to the ends of the crib for engagement with latches mounted coincidentally therewith, e.g., on the corner posts. The ends of the wire are offset so that upon rotation of the trip wire by the actuator, the offset ends likewise rotate.

Each offset end is provided with a coincidental latch means which includes an outwardly extending inclined cam surface against which the offset ends of the wire slide as the drop side is raised, being moved thereby to the top portion of the latch, in the top edge of which there is provided a recess. The trip wire is provided with torsion springs maintaining the same with the trip lock actuator in a downward position, the offset ends also being in such a downward position. However when the drop side is raised, the offset ends of the trip wire ride over the aforesaid cams and snap into the recesses, which hold the same in locked positon, so that it is not possible to rotate the trip wire actuator in the absence of deliberately raising the drop side slightly in order to disengage the offsets of the trip wire from said recesses, whereupon the trip wire actuator can be turned to completely release the offset ends from the latches.

There is also preferably provided spring means for urging the drop side downwardly to more firmly engage the offset ends of the trip wire with said recesses.

Reverse latches of a similar nature can be utilized at the lower portions of the corner posts to latch the crib in its down position, and here again there is spring means to urge the drop side slightly upwardly to make the engagement with the latch plates firmer.

BRIEF DESCRIPTION OF THE DRAWINGS

FIG. 1 is a perspective view illustrating the invention and showing the same in locked position, parts being omitted;

FIG. 2 is a view on an enlarged scale illustrating the locked position in the solid lines and the unlocking position in dotted lines, and FIG. 3 is a view locking in the direction of arrow 3 in FIG. 2.

PREFERRED EMBODIMENT OF THE INVENTION

In FIG. 1 the reference numeral 10 indicates a corner post. There is a crib drop side which comprises a lower rail 12 with upright spindles 14, 14 as usual. On the corner post there is mounted a crib drop side guide-rod 16 which is fastened as usual at the top, not shown, and extends through a horizontal portion of a bracket 18 and includes a loose spring 20 also as conventional.

At the inside aspect of the rail 12 there is a trip wire generally indicated at 22 having a central offset portion

24 which is the release actuator, and extending to both sides this actuator is provided with elongated straight portions 26 and 28 both of which terminate in offset cranks or the like generally indicated at 30. Although the right-hand end of the apparatus in FIG. 1 is not shown, both ends are exactly alike but reversed. Torsion springs 32, 32 tend to maintain the trip wire against rotation toward the observer and the ends 26 and 28 may be journaled in simple guides such as shown at 34, 34. When the trip wire actuator 24 is rotated to the rear of the crib, i.e., toward the observer in FIG. 1, the cranks 30 also rotate in the same direction.

Also located on the corner posts are brackets 36 having horizontal portions 38 which are apertured to receive the guiderod 16 and between the top of the rail 12 and the offset 38 there is located a coil spring 40 which embraces the guide-rod 16.

The bracket also includes a vertical portion 42 best seen in FIG. 2 which has an offset and rearwardly extending triangular portion 44 providing an inclined cam edge 46 and a top locking surface 48 having a downwardly extending recess or notch therein at 50. As stated there is another crank and bracket at the opposite end of the crib, the bracket being reversed.

Assuming that the drop side is in its downward position with the bottom surface of rail 12 resting on springs 20, it being desired to raise and lock the drop side, it is manually raised until the cranks 30 strike the cam surfaces 46. Then the cranks must move to the left, see FIG. 2, up the entire cam surface 46 and onto locking surface 48, at which point the torsion springs cause the trip wire to rotate in a counterclockwise direction in FIG. 2, dropping the offsets into recesses 50, locking the drop side in its uppermost position. In this position the spring 40 exerts a downward force on the top of the rail 12, maintaining the lock in the position which is shown in FIG. 1.

When it is desired to release the drop side, the same must be manually raised to the position shown in dotted lines in FIG. 2, and indicated by the numeral 30'. Thereupon the actuator 24 is moved to the rear, pivoting about the members 26, 28 as an axis and moving the cranks 30 to the dotted line position shown and indicated at 30'' in FIG. 2, whereupon the drop side is free of the locking bracket 44 and can descend to rest on springs 20.

If desired, the reverse of this arrangement can be utilized at the bottom of the crib to lock the same in the downward position.

I claim:

1. A safety trip lock for the drop side of a crib wherein said crib includes corner posts, guide rods for said drop side mounted on the corner posts, and a bracket mounted in fixed position on each of two corner posts at opposite ends of the crib at the same side thereof, each bracket comprising a plate adapted to be secured to its corner post at the inside aspect thereof, a rearwardly extending member on each bracket, each such member having an upwardly and inwardly inclined cam surface and a top edge, there being a notch in each said top edge, said drop side having a lower rail with apertures therein relatively slidably receiving the guide rods, a trip wire mounted at the inside aspect of said lower rail, said trip wire comprising a generally intermediate offset actuator portion depending from said lower rail in position to be engaged and moved rotarily inwardly of said crib, extensions at each end of said trip wire actuator portion, said extensions extending into close association with said corner posts and said brackets, each of said extensions including an offset crank, and a spring means for maintaining said trip wire in position wherein the offset actuator portion extends downwardly vertically from said drop side lower rail and said offset cranks also normally extend downwardly from said wire extensions, said offset cranks being movable inwardly of the crib upon inward rotation of said offset actuator, but being normally held in the notches in the brackets by the weight of the drop side, so that the offset actuator cannot be actuated in the absence of a slight upward motion on the entire drop side releasing the offset cranks from said notches thereby allowing the actuator thereupon to be rotated inwardly similarly rotating the offset cranks releasing the same from the latches and allowing the crib drop side to drop, spring means normally aiding the weight of the drop side to hold the offset cranks in said notches, and including a generally horizontal extension on each said bracket, said extensions being apertured to slidingly receive the drop side guide rods, said spring means being interposed between said horizontal extension and the top surface of said lower rail of the drop side.

* * * * *